US005532526A

United States Patent [19]

Ricco et al.

[11] Patent Number: 5,532,526

[45] Date of Patent: Jul. 2, 1996

[54] CONTROL CIRCUIT FOR PREDOMINANTLY INDUCTIVE LOADS IN PARTICULAR ELECTROINJECTORS

[75] Inventors: Mario Ricco, Bari; Nicola Pacucci, Bari-Carbonara; Maurizio Abate, Orbassano; Eugenio Faggioli, Turin, all of Italy

[73] Assignee: Elasis Sistema Ricerca Fiat Nel Mezzogiorno Societa Consortile per Azioni, Pomigliano D'Arco, Italy

[21] Appl. No.: 430,869

[22] Filed: Apr. 28, 1995

Related U.S. Application Data

[63] Continuation of Ser. No. 994,894, Dec. 22, 1992, abandoned.

[30] Foreign Application Priority Data

Dec. 23, 1991 [IT] Italy ..... TO91A1023

[51] Int. Cl.[6] ..... H01H 47/00

[52] U.S. Cl. ..... 307/104; 361/152; 361/189; 123/490

[58] Field of Search ..... 307/104; 361/152–166, 361/168.1, 191, 187–189; 123/490

[56] References Cited

U.S. PATENT DOCUMENTS 4,775,914 10/1988 Incardona ..... 361/190
4,933,805 6/1990 Calfus ..... 361/152
4,950,974 8/1990 Pagano ..... 323/222

FOREIGN PATENT DOCUMENTS 2538942 6/1984 France .
2653493 4/1991 France .

*Primary Examiner*—Peter S. Wong
*Assistant Examiner*—Aditya Krishnan
*Attorney, Agent, or Firm*—Ladas & Parry

[57] ABSTRACT

A control circuit for supplying a load with current having a high-amplitude portion with a rapid leading edge, and a lower-amplitude portion. The circuit is input-connected to a low-voltage supply source, and comprises a number of actuator circuits parallel-connected between the input terminals and each including a capacitor and a load. Each actuator circuit also comprises a first controlled switch between the respective load and a reference line, for enabling energy supply and storage by the respective load. A second controlled switch is provided between the capacitor line and the load line, for rapidly discharging the capacitors into the load selected by the first switch and recirculating the load current, or for charging the capacitors with the recirculated load current.

12 Claims, 5 Drawing Sheets

CONTROL CIRCUIT FOR PREDOMINANTLY INDUCTIVE LOADS IN PARTICULAR ELECTROINJECTORS

This is a continuation of application Ser. No. 07/994,894, filed on Dec. 22, 1992, now abandoned.

BACKGROUND OF THE INVENTION

The present invention relates to a control circuit for predominantly inductive loads, in particular, electroinjectors forming part of an internal combustion engine supply system.

For controlling internal combustion engine injectors, the supply current to the injectors must present a pattern comprising, in general, a rapidly increasing portion, a portion increasing more slowly, a portion oscillating about a mean value, and a rapidly decreasing portion. The circuits currently employed for achieving such a pattern substantially comprise a low-voltage supply source and a reactive circuit consisting of an inductor and capacitor for storing the energy required for producing a rapid current pulse in the load. For this purpose, the inductor is charged to a given current and then connected to the capacitor, so as to form a resonant circuit and transfer energy from the inductor to the capacitor, which is thus charged for subsequently supplying the load (injector actuator) with the required current pulse.

A major drawback of the above known circuit is that, for achieving the high currents required, large-size components such as cup-shaped or toroidal cores are used as inductors on the reactive circuit, thus increasing the size and cost of the overall circuit.

The above problem is further compounded by the fact that, for protecting the control elements of the actuators, each actuator presents a so-called "snubber" circuit comprising a capacitor and resistor connected parallel to the actuator, and which provide for absorbing and dissipating the energy of the recirculating current of the actuator. Such capacitors further increase the overall size of the circuit.

SUMMARY OF THE INVENTION

It is an object of the present invention to provide a more compact control circuit as compared with known types.

According to the present invention, there is provided a control circuit for predominantly inductive loads, in particular electroinjectors, for supplying the load with current having a high-amplitude portion with a rapid leading edge, and a lower-amplitude portion; said circuit comprising a first and second input terminal connectable to a low-voltage supply source; an energy storage circuit connected between said input terminals and including at least a capacitive element and an inductive element; a first controlled switch element located between said inductive element and a reference line, for enabling selective charging of said inductive element; a second controlled switch element for enabling rapid discharge of said capacitive element into said load; and a control unit for generating control signals for said first and second switch elements; characterized by the fact that said inductive element consists of said load.

BRIEF DESCRIPTION OF THE DRAWINGS

A preferred, non-limiting embodiment of the present invention will be described by way of example with reference to the accompanying drawings, in which.

DETAILED DESCRIPTION OF THE INVENTION

Figure 1:
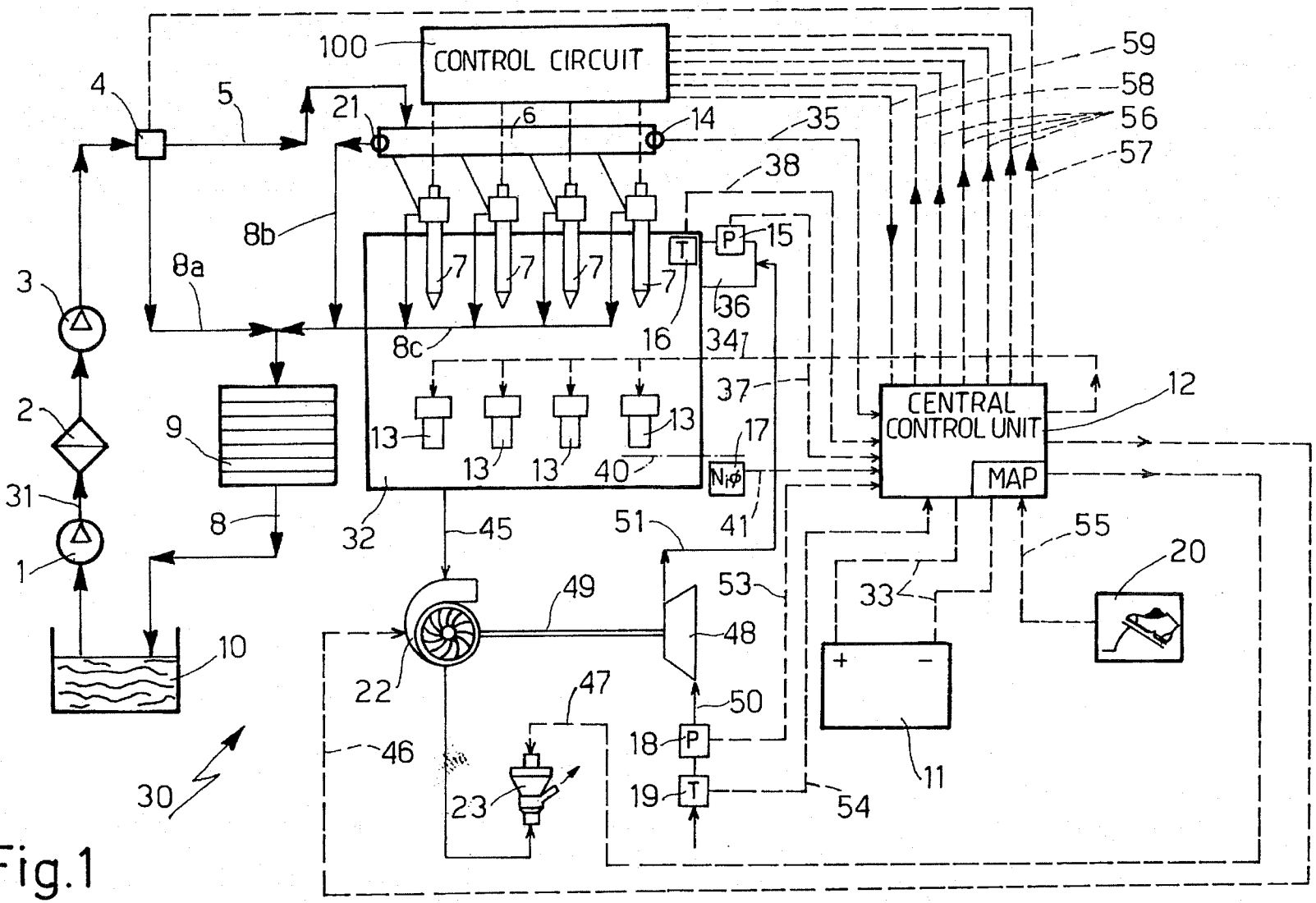
FIG. 1 shows a block diagram of a supply system including the control circuit according to the present invention.

Number 30 in FIG. 1 indicates a supply system for an internal combustion engine 32, more specifically, a supercharged diesel engine. In FIG. 1, the continuous lines indicate the fuel conduits, and the dotted lines the electric lines relative to measured quantity signals, controls and supply. More specifically, system 30 comprises:

- an electric supply pump 1 for ensuring a given head (1–3 bar) in fuel supply conduit 31;
- a fuel filter 2 on conduit 31, downstream from pump 1;
- a high-pressure pump 3 downstream from filter 2, for generating as high an injection pressure as required (up to 1500 bar);
- a high-pressure supply line 5 from pump 3;
- a pressure regulator 4 on high-pressure supply line 5 and consisting of an electronically controlled two-way valve;
- a high-pressure fuel manifold or "rail" 6 connected to supply line 5 and having one or more connecting pipes to a number of injectors 7, one for each cylinder of engine 32;
- a low-pressure fuel return line 8 having a number of branches: branch **8*a* connected to pressure regulator 4, branch 8*b* connected to manifold 6, and branch 8*c* connected to injectors 7**;
- a radiator 9 on return line 8, for cooling the feedback fuel;
- a fuel tank 10 from which fuel is withdrawn by supply conduit 31 and into which fuel is drained by return line 8;
- a system supply battery 11;
- a control and power unit (central control unit) 12 supplied by battery 11 via lines 33, and by which the unit is controlled on the basis of signals from various sensors;
- spark plugs or starters 13, one for each cylinder of engine 32, for heating the cylinder when the engine is started, and which are controlled by unit 12 via output line 34;
- an overpressure valve 21 inside manifold 6 and connected to branch **8*b* of return line 8**;
- a combustion product exhaust conduit 45 connected to the exhaust manifold (not shown) of engine 32;
- a turbine 22 of variable geometry on exhaust conduit 45 and controlled by unit 12 via output line 46;
- an exhaust gas recirculating valve 23 on exhaust conduit 45, downstream from turbine 22, and connected to an output of unit 12 over line 47;
- a compressor 48 connected to output shaft 49 of turbine 22, supplied with ambient air by air supply conduit 50, and supplying intake manifold 36 via pressurized air supply conduit 51;
- a first pressure sensor 14 on manifold 6 and connected to an input of unit 12 over line 35;
- a second pressure sensor 15 on intake manifold 36 of engine 32, for detecting the air pressure in the intake manifold and accordingly supplying an electric signal to unit 12 over line 37;

a first temperature sensor 16 on the cylinder head of engine 32, for detecting its temperature and connected to an input of unit 12 over line 38;

an engine speed and stroke sensor 17 on output shaft 40 of the engine and connected to an input of unit 12 over line 41;

a third pressure sensor 18 and second outside (ambient) air temperature sensor 19 on air supply conduit 50, and connected to respective inputs of unit 12 over respective lines 53 and 54;

an accelerator pedal position sensor 20 connected to an input of unit 12 over line 55.

Central control unit 12 is connected to a control circuit 100 for the injectors 7 over a number of supply lines 56, one for each injector 7, for controlling the injection phases and to pressure regulator 4 over line 57. Unit 12 and control circuit 100 are also connected over line 58 from unit 12 and line 59 from circuit 100, as explained in more detail later on.

Figure 2:
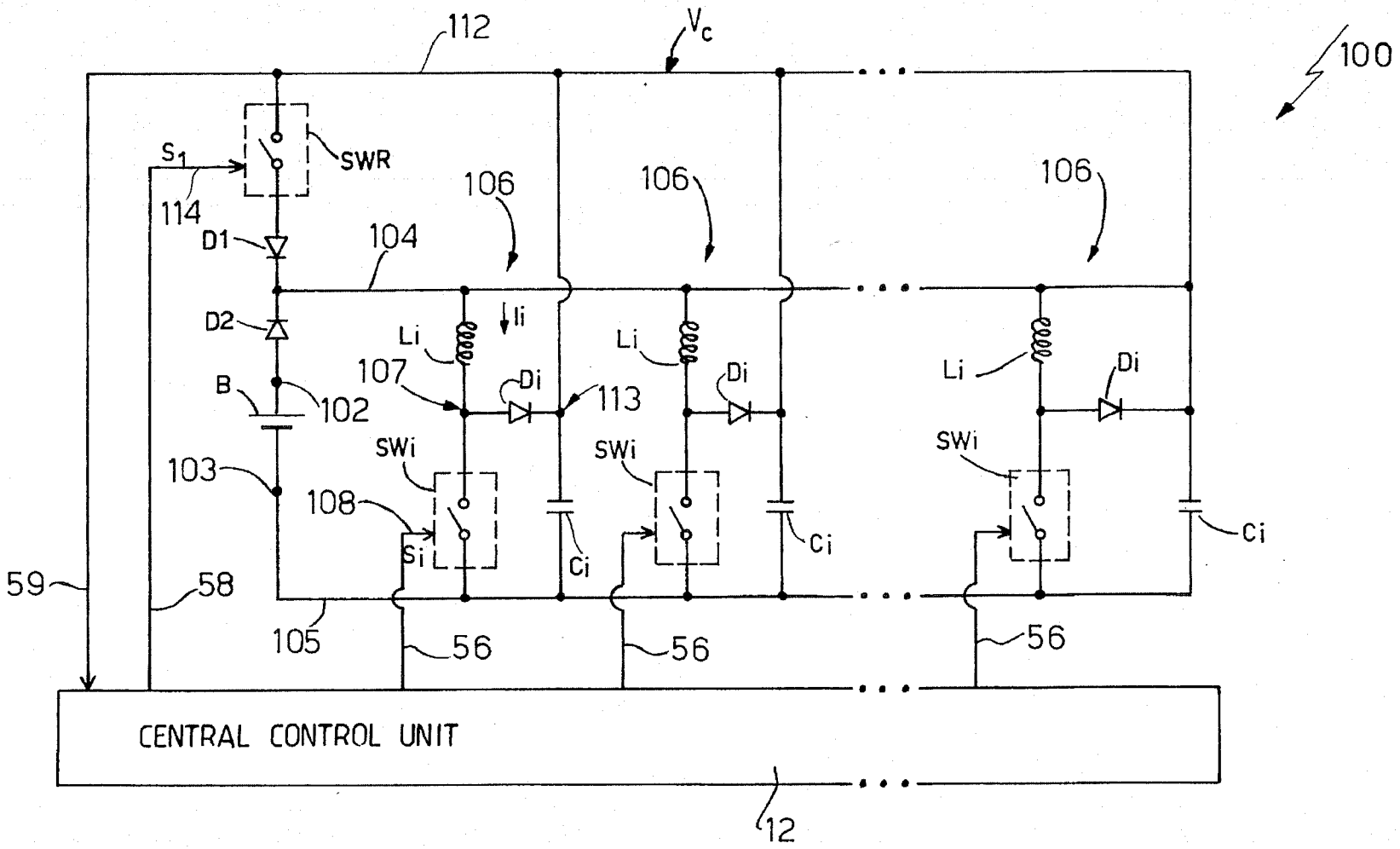
FIG. 2 shows a simplified diagram of the circuit according to the present invention.

With reference to FIG. 2, control circuit 100 comprises two input terminals 102 and 103 connectable to a supply source B consisting of a low-voltage battery. More specifically, terminal 102 is connected to the anode of a diode D2, the cathode of which is connected to a first common line 104 (e.g., actuator line); and terminal 103 is connected directly to a second common line 105 (ground).

Circuit 100 also comprises a number of actuator circuits 106 parallel connected between lines 104 and 105, and each comprising an actuator Li, a storage capacitor Ci, a coupling diode Di, and a controlled electronic switch SWi. More specifically, each actuator Li, consisting of a coil wound about a core and defining the predominantly inductive load, presents one terminal connected to line 104, and an opposite terminal, defining a node 107, connected to the anode of diode Di for connecting actuator Li to a third common line 112 (capacitance line). The cathode of each diode Di is connected to a second node 113 that is in turn connected to the capacitance line 112 and to the a first terminal of respective capacitor Ci, which provides for storing energy at a higher voltage than battery B, and the other terminal of which is connected to the ground line 105. Each switch SWi, which provides for connecting actuator Li to battery B and for transferring energy from actuator Li to the circuit consisting of the parallel connection of storage capacitors Ci, is located between node 107 and ground 105, and presents a control input 108 connected to unit 12 via control line 56, over which unit 12 supplies a signal $s_i$ for selecting the actuator to be enabled, as described in more detail later on.

Circuit 100 also comprises the series connection of an electronic switch SWR and a diode D1, which provide for connecting capacitance line 112 to actuator line 104 and for recirculating the current in load Li. More specifically, switch SWR presents a first terminal connected to capacitance line 112; a second terminal connected to the anode of diode D1, the cathode of which is connected to actuator line 104; and a control terminal 114 connected to unit 12 via control line 58 over which unit 12 supplies a signal $s_1$ for controlling switch SWR. Finally, line 112 is connected to unit 12 via line 59 for enabling unit 12 to monitor the voltage on line 112.

Circuit 100 charges storage capacitors Ci to an appropriate voltage, and supplies actuators Li with current Ii, the pattern of which presents a high-amplitude portion with a rapid leading edge, followed by a lower-amplitude portion terminating with a rapid trailing edge, as described below with reference to FIGS. 3 to 5.

Figure 3:
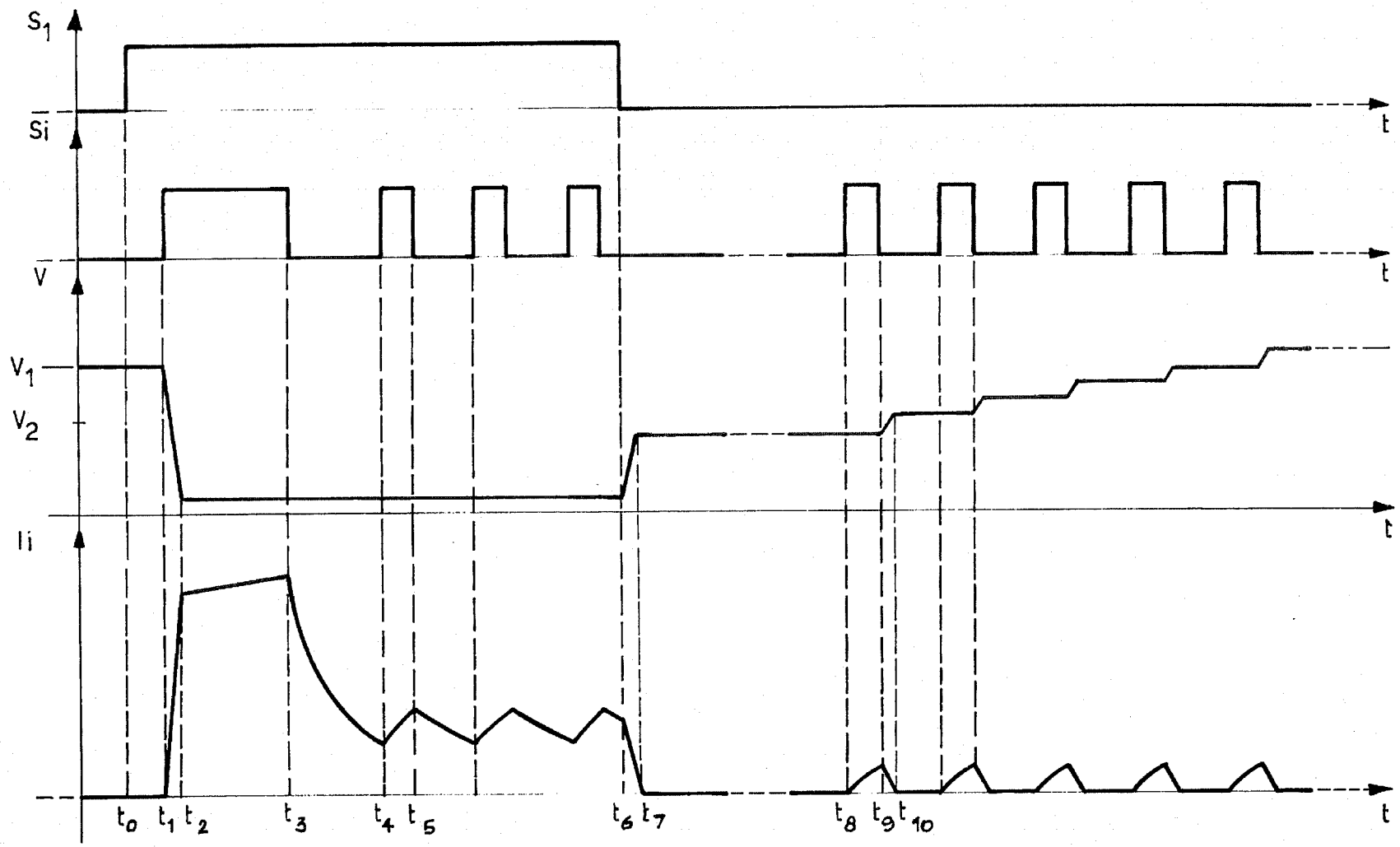
FIG. 3 shows a time graph of a number of quantities in the FIG. 2 circuit and relative to a first operating mode of the circuit.

With reference to FIG. 3, let us assume, to begin with, that switches SWR and SWi are open (low logic level of signals $s_1$ and $s_i$); and storage capacitors Ci are charged to a given high voltage (voltage $V_C$ of value $V_1$), so that the voltage drop between capacitance line 112 and actuator line 104 is such as to reverse-bias diodes Di, and current Ii in the actuators is zero.

At instant $t_0$, switch SWR is closed, so as to switch actuator line 104 to the voltage level of capacitance line 112.

At instant $t_1$, unit 12 selects the required actuator Li by switching respective signal $s_i$ to high and so closing respective switch SWi, so that the selected actuator Li is connected between capacitance line 112 and ground 105, parallel to capacitors Ci with which it forms a resonant circuit. In the selected actuator, a current pulse is therefore formed consisting of a high-frequency sinusoid portion (the value of which is determined by the inductance of actuator Li and the capacitance of capacitors Ci) and produced by rapid discharge of the energy stored in capacitors Ci, thus resulting in a simultaneous rapid reduction in voltage $V_C$ of capacitors Ci. The capacitors continue discharging up to instant $t_2$, at which point voltage $V_C$ in line 112 is approximately equal to the voltage of battery B, so that diode D2 is biased directly and connects battery B to actuator line 104. As of instant $t_2$, the selected actuator Li is supplied by low-voltage battery B, and its current Ii increases slowly with a time constant of L/R, where L is the inductance of actuator Li, and R the resistance of the actuator coil, battery B, components D2 and SWi, and the connecting line. In this phase, the selected actuator diode Di remains reverse-biased.

The above phase continues up to instant $t_3$, at which point switch SWi is opened (signal $s_i$ switched to low), so that the selected actuator diode Di is biased directly and operates as a "free-wheeling" diode, thus enabling discharge of the previously charged actuator Li and recirculation of current Li via capacitance line 112 and switch SWR. In this phase, current Ii therefore decreases with a time constant of L/R, where R is the resistance of the actuator coil and components Di, SWR and D1.

At instant $t_4$, switch SWi is again closed, the selected actuator Li is again charged by battery B, and respective diode Di opens to disconnect capacitance line 112. In this phase, current Ii in the actuator again increases with a time constant of L/R, where R is the resistance of the actuator coil, components B, D2 and SWi, and the connecting line, despite the L value differing as compared with phase $t_2$–$t_3$, due to the different current level. When switch SWi is opened at instant $t_5$, actuator Li is again discharged, so that, by appropriately opening and closing switch SWi, the current in actuator Li may be maintained in such a manner as to oscillate about a predetermined medium-low value.

For rapidly discharging actuator Li, switches SWR and SWi are opened successively. In the FIG. 3 case, in particular, switch SWR is opened at instant $t_6$ with switch SWi open. In this phase, diode Di is biased directly, so as to connect actuator Li to capacitance line 112 and again form a resonant circuit; actuator Li therefore discharges rapidly into capacitors Ci; current Ii decreases in the form of a high-frequency sinusoid portion; and the energy previously stored by actuator Li is transferred to capacitors Ci, the voltage of which thus increases rapidly. The above phase continues until the current in actuator Li is zeroed, which corresponds to a first charge of capacitors Ci to voltage $V_2$, at which point diode Di is disabled for preventing the sign of the current in the inductor from being inverted (instant $t_7$). Subsequently, capacitors Ci remain charged to voltage $V_2$, by virtue of being isolated from the rest of the circuit.

As shown in FIG. 3, at instant $t_8$, unit 12 again closes one or more of switches SWi, so as to again close the circuit including battery B and the actuator Li relative to each closed switch SWi, so that each actuator Li is supplied with current increasing with a time constant of L/R. In this phase, capacitors Ci remain isolated. At instant $t_9$, switch SWi (or all the switches closed previously) is again opened, so that, as in interval $t_6$–$t_7$, energy is transferred from the actuator to capacitors Ci, current Ii in actuator Li is zeroed (instant $t_{10}$), and the voltage in capacitance line 112 increases. By repeating the above two phases and appropriately selecting the closing times of switch/es SWi, it is possible to charge the capacitors gradually to the required level $V_1$, by first charging actuators Li to such a value as to avoid activating them, and then discharging the actuators into the capacitors.

Figure 4:
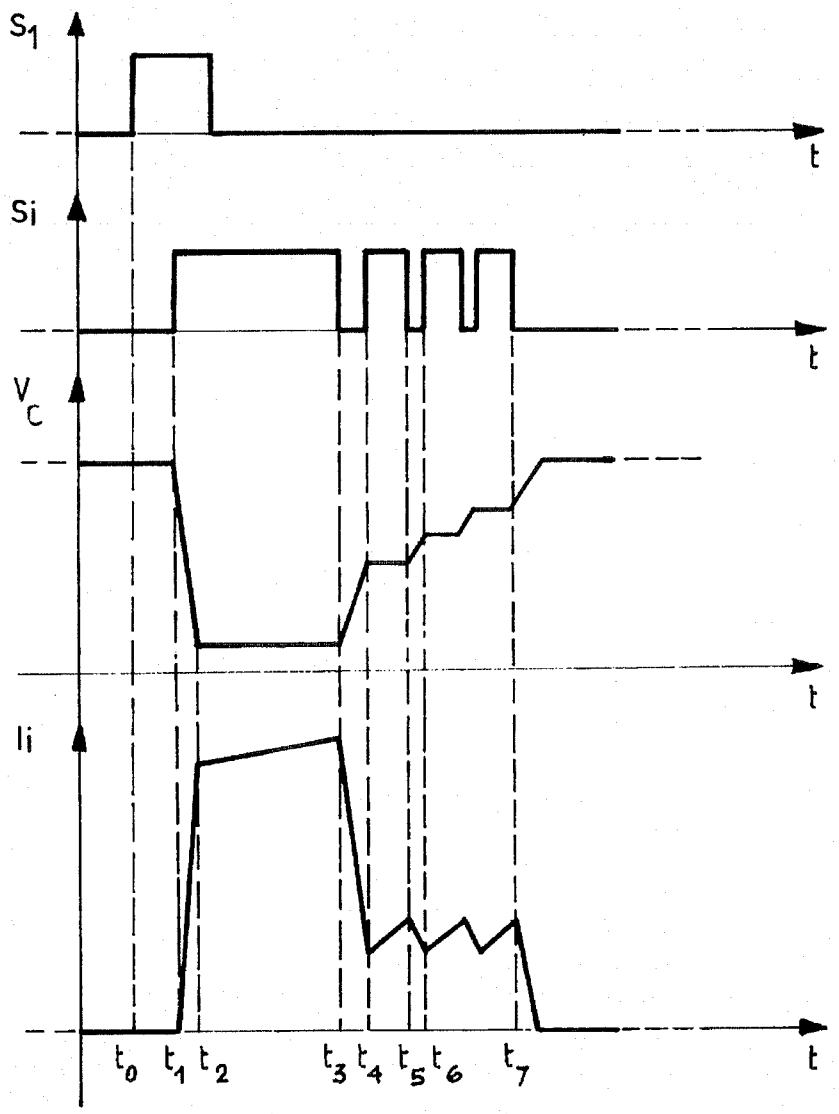
FIG. 4 shows a time graph of the FIG. 3 quantities relative to a second operating mode of the circuit.

The FIG. 2 circuit also provides for a second operating mode, as shown in FIG. 4. In this case, as in the FIG. 3 mode, capacitors Ci are initially charged to level $V_1$; switches SWR and SWi are open; actuator line 104 is switched to level $V_1$ when switch SWR is closed (instant $t_0$); closure of a given switch SWi (instant $t_1$) provides for selecting a given actuator Li, generating a current pulse in the actuator, and rapidly charging the actuator at the expense of capacitors Ci, which discharge to approximately the value of battery B (instant $t_2$); and the selected actuator Li is subsequently supplied by battery B, until the relative switch SWi is opened (instant $t_3$). The fact that, in the second operating mode, switch SWR is opened in the interval $t_2$–$t_3$ in no way affects operation of the circuit as described above.

Unlike the FIG. 3 mode, however, when switch SWi is opened (instant $t_3$), actuator Li is prevented from discharging through the circuit including switch SWR, so that energy can only be transferred from actuator Li to capacitors Ci, thus resulting in a first charge of capacitors Ci in interval $t_3$–$t_4$, as shown in FIG. 4. When switch SWi is closed (instant $t_4$), actuator Li is again connected to the circuit including battery B, and so begins charging via diode D2, while the relative diode Di is disabled for disconnecting actuator Li from capacitance line 112, which is thus maintained at the previous voltage level. At instant $t_5$, switch SWi is again opened, so that the energy stored by actuator Li in the foregoing interval $t_4$–$t_5$ is transferred to capacitors Ci, which are thus charged directly by the selected actuator during the low-current operating phase, using the recirculating current of the actuator itself.

The current in the actuator is zeroed by keeping the relative switch SWi open subsequent to instant $t_7$, as shown in FIG. 4.

In the FIG. 4 operating mode, the voltage of capacitors Ci may be limited to a predetermined value by appropriately delaying the opening of switch SWR subsequent to instant $t_3$, so that the initial opening phases of switches SWi provide for recirculating the actuator current through switch SWR, without charging capacitors Ci, which are only charged after a given number of opening and closing cycles of switches SWi.

In other words, according to the present invention, the energy stored in actuators Li, instead of being dissipated, as in known circuits, during the recirculating phase, is employed for charging capacitors Ci, which in turn provide for rapidly supplying the selected actuators. As such, energy is transferred continually in alternate phases between the actuators and capacitors, thus reducing the number of components and dissipation of the circuit, as well as increasing the rapidity with which the various phases are performed. Moreover, connection of actuator circuits 106 to the same line 104 provides for transferring energy from one circuit 106 to the next according to the injection phases provided for by unit 12.

The resulting high-speed response of the circuit also provides for achieving a pilot injection phase prior to actual injection. Proposals have been made, in fact, for preceding actual injection with a shorter pilot injection phase, for initiating combustion with a limited amount of fuel and so reducing the rate of heat release, noise level, and the formation of nitric oxide. Despite the proved effectiveness of a pilot injection phase, particularly at low speed and/or under partial load conditions, the delays introduced by the control circuit components and injectors and the operating frequency involved currently prevent two distinct injection phases from being achieved in rapid succession. In actual practice, in fact, the two phases merge, with one continuous opening operation of the injector ranging from the start of the pilot phase to the end of the actual injection phase.

By virtue of transferring energy from the actuators to the capacitors during the discharge phase, however, the present invention provides for achieving a pilot phase temporally distinct from the actual injection phase.

Figure 5:
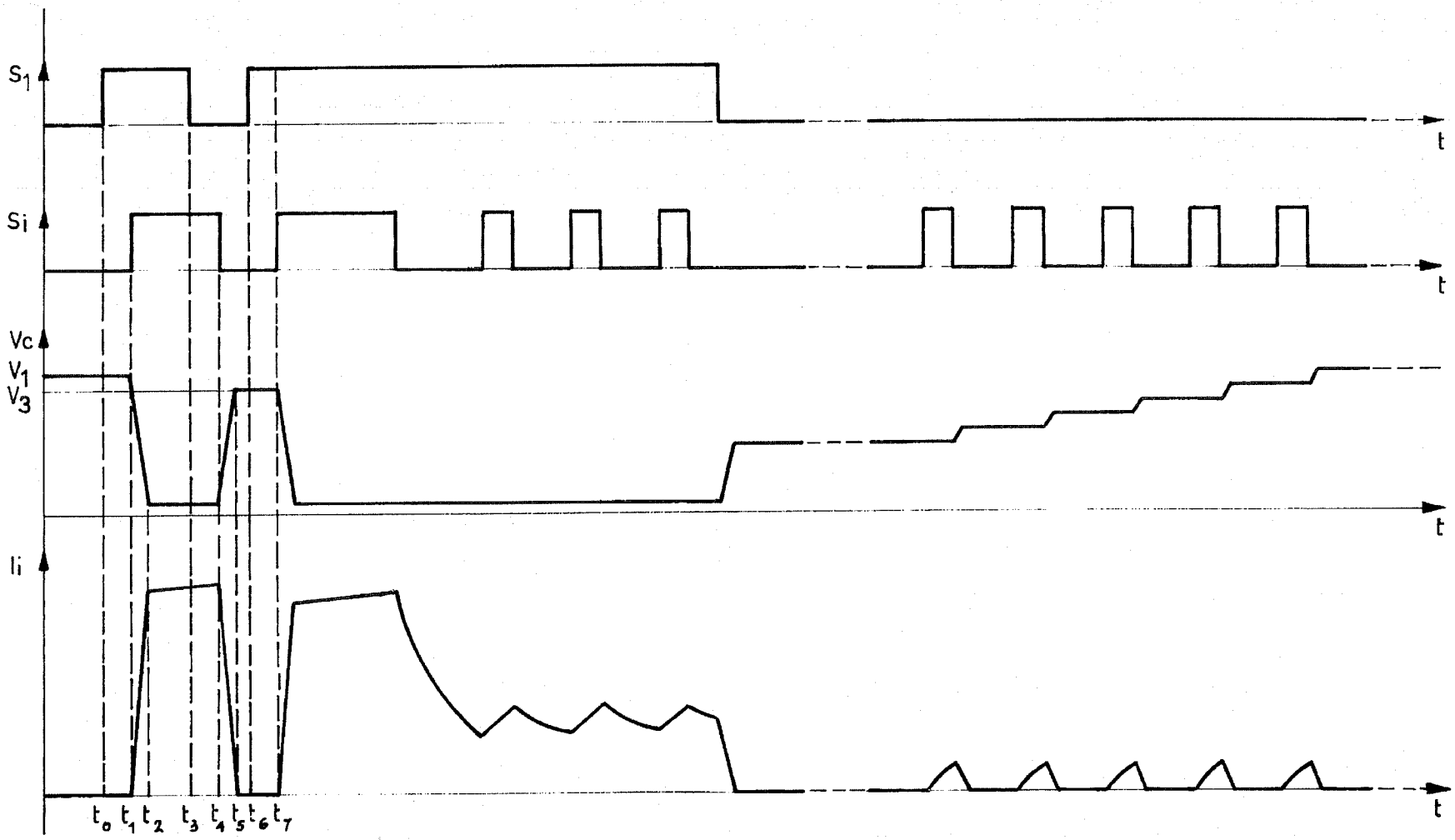
FIG. 5 shows a time graph of the FIGS. 2–3 quantities relative to a third operating mode of the circuit.

One embodiment of such a pilot injection phase will be described with reference to FIG. 5 showing time graphs of quantities $s_1$, $s_i$, $V_C$ and Ii. Initially, signals $s_1$ and $s_i$ are low, capacitors Ci are charged to voltage $V_C$ of value $V_1$, and the actuators are discharged. As in FIGS. 3 and 4, at instant $t_0$, switch SWR is closed (by switching signal $s_1$) and, at instant $t_1$, switch SWi of the selected actuator is closed, thus generating a current pulse Ii in the actuator due to rapid discharge of capacitors Ci. At instant $t_2$, the voltage in capacitance line 112 equals that of battery B, which therefore takes over supply of the actuator from capacitors Ci, thus enabling a further, slower, increase in current Ii of actuator Li (pilot injection phase). At instant $t_3$, switch SWR is again opened; and, at instant $t_4$, switch SWi is also opened, so that the current in actuator Li falls rapidly to zero at instant $t_5$, and, at the same time, the voltage in capacitors Ci increases rapidly to value $V_3$ by virtue of the energy in actuator Li being transferred to capacitors Ci. At instant $t_6$, switch SWR is again closed; and, at instant $t_7$, switch SWi of the actuator previously selected for the pilot phase is again closed, followed by the actual, longer, injection phase according to either one of the operating modes in FIGS. 3 and 4. In the FIG. 5 example, the actual injection phase is performed as shown in FIG. 3 and therefore requires no further description.

By virtue of employing the actuators for charging capacitors Ci, the circuit according to the present invention provides for achieving the required current patterns with no need for auxiliary inductors or capacitors. Moreover, by virtue of the recirculating current of actuators Li being absorbed by and charging capacitors Ci, no "snubbing" capacitors are required, as on known circuits, for protecting switches SWi, thus greatly reducing the size and cost of the circuit according to the present invention.

To those skilled in the art it will be clear that changed may be made to the circuit as described and illustrated herein without, however, departing from the scope of the present invention. For example, the number of circuits 106 depends on the number of actuators Li, and may vary as required.

What is claimed is:

1. In a combination of a control circuit (100) and a predominantly inductive load said control circuit being for supplying said load with current (Ii) having a high-amplitude portion with a rapid leading edge and a lower-amplitude portion said circuit (100), the improved combination comprising:

first and second input terminals (102, 103) for connection to a voltage source (B);

an energy storage circuit (106) connected between said first and second input terminals and comprising an inductive element (Li) of said load and a capacitive element (Ci);

a first controlled switch element (SWi) connected between said inductive element and a reference line (105) for enabling selective charging of said inductive element;

a second controlled switch element (SWR) connected for enabling rapid discharge of said capacitive element into said load;

a control unit (12) for generating control signals ($s_i$, $s_1$) respectively for said first and second switch elements (SWi, SWR);

means (12) for closing said first and second switch elements (SWi, SWR) when said capacitive element (Ci) is charged, and rapidly discharging said capacitive element into said load (Li);

means for consecutively opening and closing said first switch element (SWi) when said second switch element (SWR) is closed, and producing small current pulses in said load with no energy transfer between said load and said capacitive element; and means for consecutively opening and closing said first switch element (SWi) when said second switch element (SWR) is open, for producing small current pulses in said load and subsequently transferring energy from said load to said capacitive element.

2. A circuit and load as claimed in claim 1, wherein said load (Li) presents a first terminal (104) connected to said first input terminal (102); said reference line (105) is connected to said second input terminal (103); said load (Li) is connected to said first switch element (SWi) by a second terminal defining a first node (107) connected to a second node (113) consisting of a first terminal of said capacitive element (Ci); and said second switch element (SWR) is located between said second node (113) and said first terminal (104) of said load.

3. A circuit and load as claimed in claim 2, wherein said capacitive element (Ci) presents a second terminal connected to said reference line (105).

4. A circuit and load as claimed in claim 2, wherein said first and second nodes (107, 113) are connected by a first unipolar switch (Di) enabling current to flow from said load (Li) to said capacitive element (Ci); by the fact that, between said first input terminal (102) and said first terminal (104) of said load (Li), there is provided a second unipolar switch (D2) enabling current to flow from said first input terminal to said load; and by the fact that, between said second switch element (SWR) and said first terminal (104) of said load, there is provided a third unipolar switch (D1) enabling current to flow from said second switch element to said load.

5. A circuit and load as claimed in claim 4, wherein said first, second and third unipolar switches (Di, D2, D1) consist of junction diodes.

6. A circuit and load as claimed in claim 1, wherein said first and second switch elements (SWi, SWR) both present a control terminal (108, 114) connected to said control unit (12).

7. A circuit and load as claimed in claim 1, and comprising at least one more said energy storage circuit and load parallel connected to the former thereof, each energy storage circuit including one of said loads (Li) as the inductive element, and one of said first switch elements (SWi) selectively controlled by said control unit (12) for activating that one of said loads.

8. In a combination of a control circuit (100) and a predominantly inductive load said control circuit being for supplying said load with current (Ii) having a high-amplitude portion with a rapid leading edge and a lower-amplitude portion said circuit (100), wherein said load comprises an electroinjector actuator, the improved combination comprising:

first and second input terminals (102, 103) for connection to a voltage source (B);

an energy storage circuit (106) connected between said first and second input terminals and comprising an inductive element (Li) of said load and a capacitive element (Ci);

a first controlled switch element (SWi) connected between said inductive element and a reference line (105) for enabling selective charging of said inductive element;

a second controlled switch element (SWR) connected for enabling rapid discharge of said capacitive element into said load;

a control unit (12) for generating control signals ($s_i$, $s_1$) respectively for said first and second switch elements (SWi, SWR);

means (12) for closing said first and second switch elements (SWi, SWR) when said capacitive element (Ci) is charged, and rapidly discharging said capacitive element into said load (Li); and means for consecutively opening said first and second switch elements (SWi, SWR), and rapidly discharging said load (Li) into said capacitive element (Ci).

9. A circuit and load as claimed in claim 8, wherein:

said load (Li) presents a first terminal (104) connected to said first input terminal (102); said reference line (105) is connected to said second input terminal (103);

said load (Li) is connected to said first switch element (SWi) by a second terminal defining a first node (107) connected to a second node (113) consisting of a first terminal of said capacitive element (Ci); and said second switch element (SWR) is located between said second node (113) and said first terminal (104) of said load.

10. A circuit and load as claimed in claim 9, wherein said capacitive element (Ci) presents a second terminal connected to said reference line (105).

11. A circuit and load as claimed in claim 9, wherein:

said first and second nodes (107, 113) are connected by a first unipolar switch (Di) enabling current to flow from said load (Li) to said capacitive element (Ci);

said first input terminal (102) and said first terminal (104) of said load (Li), there is provided a second unipolar switch (D2) enabling current to flow from said first input terminal to said load; and between said second switch element (SWR) and said first terminal (104) of said load, there is provided a third unipolar switch (D1) enabling current to flow from said second switch element to said load.

12. A circuit as claimed in claim 11, wherein said first, second and third unipolar switches (Di, D2, D1) consist of junction diodes.

* * * * *